US011763633B2

(12) United States Patent
Visser et al.

(10) Patent No.: US 11,763,633 B2
(45) Date of Patent: Sep. 19, 2023

(54) GAMING SYSTEM

(71) Applicant: Habanero Systems B.V., Willemstad (CW)

(72) Inventors: Christiaan Krige Visser, Ekurhuleni Gauteng (ZA); Nickolas Ioannoy, Edenvale Gauteng (ZA); Anton Carl Swart, Taipei (TW)

(73) Assignee: Habanero Systems B.V., Willemstad (CW)

( * ) Notice: Subject to any disclaimer, the term of this patent is extended or adjusted under 35 U.S.C. 154(b) by 178 days.

(21) Appl. No.: 16/777,072

(22) Filed: Jan. 30, 2020

(65) Prior Publication Data

US 2020/0273295 A1 Aug. 27, 2020

(30) Foreign Application Priority Data

Jan. 31, 2019 (EP) ..... 19020051

(51) Int. Cl.
*G07F 17/32* (2006.01)
*G07F 17/34* (2006.01)

(52) U.S. Cl.
CPC ..... *G07F 17/3269* (2013.01); *G07F 17/3213* (2013.01); *G07F 17/3258* (2013.01); *G07F 17/3276* (2013.01); *G07F 17/34* (2013.01)

(58) Field of Classification Search
CPC ..... G07F 17/3269; G07F 17/3213; G07F 17/3258; G07F 17/3276; G07F 17/34
See application file for complete search history.

(56) References Cited

U.S. PATENT DOCUMENTS 6,173,955 B1 * 1/2001 Perrie ..... G07F 17/34 273/138.2
2004/0242320 A1 12/2004 Jackson
(Continued)

OTHER PUBLICATIONS

European Search Report dated Apr. 30, 2019 for EP Application No. 19020051.9.

*Primary Examiner* — Robert T Clarke, Jr.
*Assistant Examiner* — Jeffrey K Wong
(74) *Attorney, Agent, or Firm* — Howard M. Gitten, Esq.; Lewis Brisbois Bisgaard & Smith LLP

(57) ABSTRACT

A jackpot race component for a gaming system provided by an operator and played by a plurality of players includes a first timer for timing a time interval, the time interval having a start and an end time each being configured in response to an input by the operator. The first timer setting the start and latest end times of a race phase. A second timer initiates, in response to an input an accumulation phase during which a jackpot prize pot is accumulated. The accumulation phase starts at the same time as or after the beginning of the race phase. A random timer starts timing at or after the first timer at the start of the race phase and randomly triggers an end to the race phase and the accumulation phase before the latest end time set by the first timer. A pay-out phase occurs in response to the end of the race phase. The pay-out phase determining a manner of pay-out by assigning positions to the players, in response to an input, at the end of the race phase, and the gaming system paying out one or more prizes from the jackpot prize pot according to a predetermined pay-out schedule as a function of the manner of pay-out.

15 Claims, 6 Drawing Sheets

(56) References Cited

U.S. PATENT DOCUMENTS

| | | | | |
|---|---|---|---|---|
| 2006/0014584 | A1* | 1/2006 | Iida | G07F 17/3258 463/26 |
| 2007/0060247 | A1* | 3/2007 | Low | G07F 17/32 463/16 |
| 2008/0188296 | A1* | 8/2008 | Seelig | G07F 17/3258 463/27 |
| 2010/0124988 | A1 | 5/2010 | Amos et al. | |
| 2011/0124408 | A1* | 5/2011 | Ward | G07F 17/3223 463/27 |
| 2011/0218033 | A1* | 9/2011 | Englman | G07F 17/3262 463/25 |
| 2016/0055714 | A1 | 2/2016 | Baerlocher et al. | |

* cited by examiner

GAMING SYSTEM

CROSS REFERENCE TO RELATED APPLICATION

This is a Continuation in Part of European Patent Application No. EP 19020051.9 filed Jan. 31, 2019 entitled "An Improved Gaming System" the contents of which are hereby incorporated by reference.

BACKGROUND OF THE INVENTION

This invention relates to improvements to gaming systems and in particular, to the addition of a jackpot race component to a game.

Games and gaming systems are known, in both the mechanical form and electronic form and games are also widely played on the internet. Operators provide a platform for players to play in the hope of winning prizes. Games can take many forms and slot machines having spinning wheels or rotating wheels also known as reels having characters or figures or symbols on them which must be matched or aligned are well known. Such games normally pay a prize if a given number of characters are matched in a row.

Lottery type gaming systems are also known in which players play in the hope of winning a large jackpot or prize.

The present invention provides for a jackpot prize to be available in addition to any ordinary prize from playing a normal or other known type of game

BRIEF DESCRIPTION OF THE DRAWINGS

The present disclosure will be better understood by reading the written description with reference to the accompanying drawing figure in which like reference numerals denotes similar structure and referred to like elements throughout which.

SUMMARY OF THE INVENTION

Figure 1:
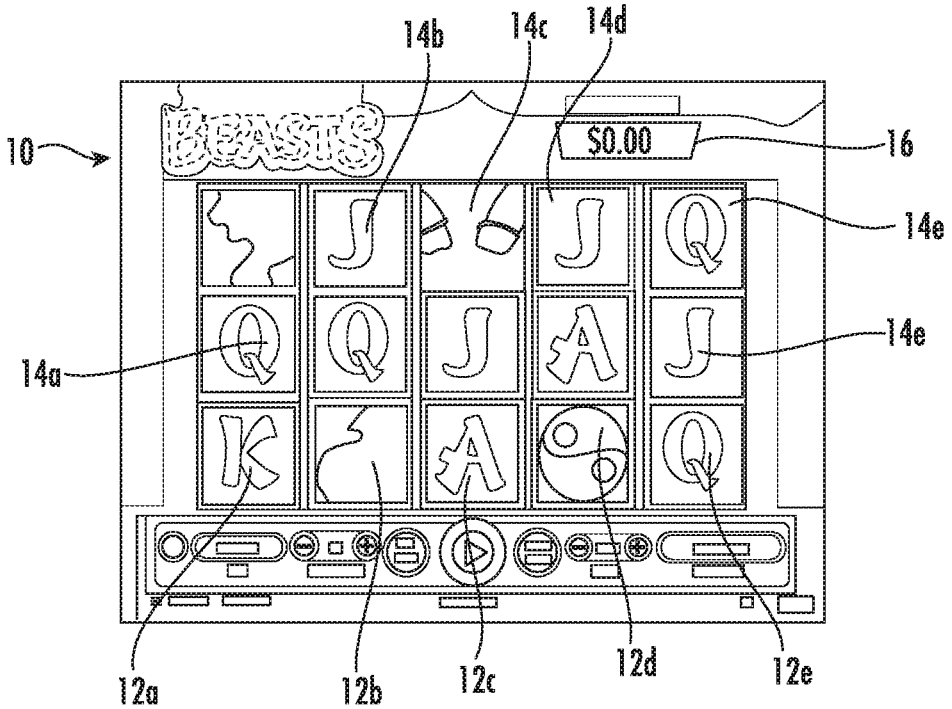
FIG. 1 shows an example of a display at the beginning of an accumulation phase in accordance with the invention.

According to the present invention there is provided a jackpot race component for a gaming system provided by an operator and played by a plurality of players. The jackpot race component includes a first timer for timing a time interval, the time interval having a start time and an end time; each being configured in response to an input by the operator. The first timer setting the start time and latest end time of a race phase. A second timer initiates, in response to an operator input, an accumulation phase during which a jackpot prize pot is accumulated. The accumulation phase starts at the same time as or after the beginning of the race phase. A random timer starts timing at or after the first timer at the start of the race phase and randomly triggers an end to the race phase and the accumulation phase before the latest end time set by the first timer. A pay-out phase occurs in response to the end of the race phase and the pay-out phase determines a manner of pay-out in response to an operator input of assigned positions to the players at the end of the race phase, and the gaming system paying out one or more prizes from the jackpot prize pot according to a predetermined pay-out schedule as a function of the manner of pay-out.

The jackpot component for a gaming system can be played by a plurality of players, the jackpot component including a first timer for timing a time interval. The time interval having a start time and an end time; each being configured in response to an input by the operator. The first timer setting the start and latest end times of a race phase. A second timer initiates, in response to an operator input, an accumulation phase during which a jackpot prize pot is accumulated. The accumulation phase starts at the same time as or after the beginning of the race phase. A random timer starts timing at or after the first timer at the start of the race phase and randomly triggers an end to the race phase and the accumulation phase before the latest end time set by the first timer. A pay-out phase occurs in response to the end of the race phase and the pay-out phase determines a manner of pay-out in response to an operator input of assigned positions to the players at the end of the race phase end period, and the gaming system paying out one or more prizes from the jackpot prize pot according to a predetermined pay-out schedule as a function of the manner of pay-out.

Advantageously, the random nature of the jackpot trigger timer brings a surprise element to the end of the race and so neither the players nor the operator will be able to guess when the race will end, knowing only that it must end before the last time set by the operator.

A further advantage of the present invention is that it adds an extra layer of interest and excitement for the players and an opportunity for them to win additional prizes whilst playing a game.

According to another aspect of the present invention there is provided a jackpot race component in which a proportion of any wager, betting stake placed or fee paid by a player during the accumulation phase can be determined to be added to the jackpot prize pot.

This aspect is advantageous in that it enables an operator to configure or adapt the proportions of wagers, bets or fees paid to either increase the incentives to players and hopefully attract more players, or to increase the size of the profit for the operator.

According to another aspect of the present invention there is provided a jackpot race component having a display in which any one or more of the time remaining until the start of the race phase or the actual start time of the race phase or the duration of the race phase or the latest time at which the race phase can end is displayed on a display visible to the players.

Advantageously, this type of display can be used to raise the interest and excitement in a game or race and so encouraging players to continue playing and possibly also to increase their stakes or bets as the race continues.

According to another aspect of the present invention there is provided a jackpot race component configured so that after the end of the race has been triggered players are ranked in order according to how close to the jackpot trigger time the player placed a bet, wager or paid a fee.

According to another aspect of the present invention there is provided a jackpot race component in which any one or more of: 1) the number of prizes to be paid from the jackpot, 2) the fractions of the jackpot prize pot to be awarded as prizes to the players and 3) the relative sizes of the jackpot prizes is configurable as a function of an operator input.

According to another aspect of the present invention a jackpot race component is provided in which the jackpot component is added to a gaming system comprising a spinning reel or slot machine type of game.

Advantageously, it will be apparent that this type of game can be added to an electronic type of gaming system or a traditional mechanical type machine with mechanically controlled wheels or spinning drums.

According to another aspect of the present invention there is provided a method of operating a jackpot race component for a gaming system provided by an operator and played by a plurality of players. The method includes the steps of configuring a first timer, the timer having configurable start and end times to determine the start and latest end times of a race phase. A second timer initiates an accumulation phase during which a jackpot prize pot is accumulated; the accumulation phase is configured to start at the same time as or after the beginning of the race phase. Configuring a random timer to start timing at or after the first timer at the start of the race phase and randomly trigger an end to the race phase and the accumulation phase before the latest end time set by the first timer. A pay-out phase is configured to occur after the end of the race phase. Positions are assigned to the players at the end of the race phase and one or more prizes are paid out from the jackpot prize pot according to a predetermined pay-out schedule during the pay-out phase.

According to another aspect of the present invention there is provided a method of operating a jackpot race component comprising configuring any proportion of any wager, or betting stake placed or fee paid during the accumulation phase to be added to the jackpot prize pot.

A particular advantage of the present invention is that it adds an extra layer of interest and excitement for the players and an opportunity for them to win additional prizes whilst playing a game.

According to another aspect of the present invention there is provided a method of operating a jackpot race component including displaying to the players one or more of a) the time remaining until the start or b) the actual start time of the race phase, or c) the maximum race time remaining or the latest actual end time of the race phase.

A particular advantage of the extra display to display start and end times to players, including how long a race phase can still run as a maximum time is that it can increase the level of interest and the number of players and their continued participation in the race in the expectation that they will be in a position to win one of the prizes at the end of the race.

According to another aspect of the present invention there is provided a method of operating a jackpot race component including configuring any one or more of: 1) the number of prizes to be paid out in the pay-out phase, 2) the fractions of the jackpot prize pot to be awarded as prizes to the players and 3) the relative sizes of the jackpot prizes.

This aspect is advantageous in that it enables an operator to configure or adapt the proportions of wagers, bets or fees paid to either increase the incentives to players and hopefully attract more players, or to increase the size of the profit for the operator.

According to another aspect of the present invention there is provided a method of operating a jackpot race component including system according to any preceding claim in which the jackpot race component is added to a spinning wheel or slot machine type of game.

Advantageously, it will be apparent that this type of game can be added to an electronic type of gaming system or a traditional mechanical type machine with mechanically controlled wheels or spinning drums.

In the example described, a slot machine type game is described in which a plurality of rows of vertically extending ribbons or reels having different figures, characters or symbols (generally referred to hereafter as characters) printed, embossed or otherwise showing on the surface of the ribbons or reels which are presented in columns and as the characters move up and down in a vertical direction, they may pass a viewing window or a viewing range. It is known that the ribbons or reels can move in the same direction or opposite directions and it is a matter of chance where the ribbons or reels stop or are stopped by the player in relation to the viewing or alignment window. The ribbons or reels can either slow down or be stopped by the gaming machine, or means can be provided to enable them to be stopped by the player at a time of his choosing. In order to win, a predetermined and specified combination of characters from the ribbons or reels must be aligned in a horizontal line in the viewing window. Normally all the characters must be the same, but in some games different combinations of figures, characters or symbols will qualify as winning combinations and so be awarded a prize.

It will also be appreciated that the characters can be displayed not just on ribbons but on appropriately sized drums, reels or wheels which can be rotated around a suitable vertical or horizontal axis. Alternatively, such images can be generated by a computer and displayed to players on a suitable screen.

In a display used in such a gaming machine or slot machine a section of the display can be reserved for use to provide information about an additional part of a game, generally referred to hereinafter as the Jackpot Race. That section of the display, conveniently referred to hereafter as the Jackpot Display may indicate the game has the potential to have a Jackpot Race.

An accumulation phase is configurable by the operator to start and end at predetermined times and in which the operator can configure a proportion of any wager, betting stake placed or fee paid by a player during the accumulation phase to be added to the jackpot prize pot.

Conveniently, the jackpot component can be described in a number of phases. An accumulation phase can be started by the operator and used to accumulate a jackpot prize pot prior to the race itself. A predetermined portion of any bet or wager placed during the accumulation phase can be added to a jackpot prize pot, and this pot can be returned to the players at the end of the race.

Advantageously, the display can be configured to display to the players any one or more of the time remaining until the start or the actual start time of the race phase, the maximum duration of the race or the latest time at which the race can end.

In another example, the system may be configured so that after the end of the race has been triggered, players are ranked in order according to how close to the jackpot trigger time the player placed a bet, wager or paid a fee.

In another example, the operator can configure any of: 1) the number of prizes, 2) the fractions of the jackpot prize pot to be awarded as prizes to the players and 3) the relative sizes of the jackpot prizes.

Preferably, more than one prize is provided in order that more players are rewarded for their participation in the game. Normally, the total of all the jackpot prizes paid will equal the same amount as the jackpot.

It will be appreciated that the jackpot component can be added to a spinning or slot machine type of game.

Additionally, or alternatively, the display may also display the time until the next Jackpot Race begins, or the actual time it will begin. It may include symbols to indicate the race has already begun and how long it has to run, or when it will end. Additional parts of the Jackpot Display can be used to indicate the accumulated total prize available in the Jackpot and so payable to winners of the race. Alternatively, or additionally the display may just indicate the first prize, or a combination of information about the prizes to be paid, such as the first, second and third prizes. The display of these features is likely to increase the level of interest and participation by players.

Additionally, or alternatively, a method of operating a jackpot component for a gaming system provided by an operator and played by a plurality of players, includes the steps of initiating an accumulation phase during which a jackpot prize pot is accumulated. Initiating a race phase after the start of the accumulation phase, the race phase having start and end times configurable as a function of an operator input. A jackpot trigger randomly triggers an end to the race phase before the configured end time. Assigning positions to the players at the end of the race phase and paying-out one or more prizes from the jackpot prize pot according to positions of players at the end of the race and to a predetermined pay-out schedule.

Additionally, or alternatively, a method of operating a gaming system comprises configuring the start and duration of the race phase and a proportion of any wager, or betting stake placed or fee paid during the accumulation phase to be added to the jackpot prize pot.

Additionally, or alternatively the present invention comprises a gaming system in which the operator can configure the start and duration of the race phase and a proportion of any wager, or betting stake placed or fee paid during the accumulation phase to be added to the jackpot prize pot.

Additionally, or alternatively, the method of operating the gaming system comprises triggering a random timer to start at the beginning of the race and trigger an end to the race at any time before the configured end time.

Additionally, or alternatively the method of the operating a gaming system further comprises configuring any of: 1) the number of prizes, 2) the fractions of the jackpot prize pot to be awarded as prizes to the players and 3) the relative sizes of the jackpot prizes.

Additionally, or alternatively, the method of the operating a jackpot component further includes during the accumulation phase, players playing a game and placing bets, wagers or paying a fee, during which at least a part of the bet, wager or fee is added to accumulate the jackpot prize pot. The race phase being initiated after the start of the accumulation phase. The race phase having configurable start and end times. A jackpot trigger is set to randomly trigger an end to the race phase before the configured end time. Assigning positions to the players at the end of the race phase according to how close to the jackpot trigger time the player placed a bet, wager or fee and paying-out one or more prizes from the jackpot prize pot according to positions of players at the end of the race and to a predetermined pay-out schedule.

Advantageously, the operator is able to configure the jackpot component so that a chosen percentage of the bets or wagers or fees paid to play the games are added to the jackpot prize pot during the accumulation phase and the race phase. At the end of the race, the operator will assign positions to the players in order that they may be paid prizes according to a predetermined pay-out schedule. The positions of the players will rank them so that the first player and first prize is awarded to the player who places a bet, wager or pays a fee closest to the time the jackpot trigger signals the end of the race. The second prize will be awarded to the second position player who is next closest and the third prize to the third player and so on. All of the factors relating to the Jackpot Race may be configurable by the operator. The Jackpot Race can be generally considered to have a number of phases: an accumulation phase, a race phase and a pay-out phase. Each of these phases can be further sub-divided if convenient or desired. The operator may configure the system to determine when an accumulation phase begins. In addition, the operator and can configure it to determine the percentage of the wagers or betting stakes that are to be added to the Jackpot prize pot.

The operator can determine when a Jackpot Race starts and the latest time at which it can end, displaying this information on a part of the display visible to the players. The operator cannot and does not configure the precise time at which the race ends; this is done by a random timer operating within the constraints set by the operator. The operator may also choose to apply minimum value of stake or wager to be placed by a player if they are to participate in the Jackpot Race.

During the accumulation phase, a percentage of the stakes or wagers being placed are added to the jackpot, this percentage can be determined by the operator. The total value of the jackpot prize pot may be displayed as a running and growing total on the display visible to the players and indeed may provide an added incentive to participate or continue participating.

At the predetermined time the Race will begin. Participants in the race will be made aware the race has begun because an element of the display will be used to indicate this. They can also be made aware of the maximum length of time the race will last.

At some time during the race, the Jackpot will be triggered and the race ends at that time. The time at which the jackpot is triggered is random and not specifically set by the operator and will not be known to the players in advance. Various means can be envisaged to trigger when the race will be ended and the Jackpot will be paid out. This may be, for example, a random number generator coupled to a timer system operating during the race.

Once the jackpot is triggered, the race is ended. The accumulation phase also ends at the time the race ends. Players are then allocated positions according to their place in the race. This may be based upon rules set by the operator, but generally relating to the player with the current bet or wager that was active at the time the jackpot was triggered or a fee paid to initiate and participate in a game. In practice this phase only takes a very short time before all the positions in the race are assigned to players.

Preferably, the jackpot is shared among a number of players. The operator can determine a race pay-out table according to his needs or those of the local regulations. A non-limiting example of such a table is given below.

TABLE 1

| Position | Winners | % |
|---|---|---|
| 1 | 1 | 35.00% |
| 2 | 1 | 25.00% |
| 3 | 1 | 15.00% |
| 4 | 1 | 10.00% |
| 5 | 1 | 5.00% |
| 6 | 1 | 3.00% |
| 7 | 1 | 3.00% |
| 8 | 1 | 3.00% |
| 9 | 1 | 3.00% |
| 10 | 1 | 3.00% |

Preferably, all the positions and winners in the race should add to 100% and all the accumulated jackpot is paid out. However, if this is not the case, any amount remaining can be rolled over to the next race.

An operator may wish to also include certain requirements that a player must be "active" in a race or game in order to qualify for an opportunity to win the jackpot or a share of it. Such conditions would be required in order to prevent a player playing once and placing a wager or bet at the beginning of a race and not participating again before the jackpot is triggered. This is particularly likely to be a requirement if the jackpot prize is to be shared by a number of players. A player may be considered active if he has played, and placed a bet or a wager or paid a fee to participate within three minutes of the triggering of the jackpot.

In the event that the pay-out table or scheme configured by the operator has more positions on it than players who fulfill the criteria of being active at the time the end of the race is triggered and the jackpot is due to be paid out, then the part of the jackpot not paid out as prizes can either be rolled over onto the next race or retained by the operator.

Additionally, the system will normally be configured so that a player can only win one position in the race. If a player is a winner, the Jackpot Win, amount and position in the race is displayed to the winner. Once all positions are paid out—the jackpot resets to zero or any amount not paid out is rolled into the next Jackpot and re-enters the Accumulation Phase.

Optionally, the display will show a summary of the last race showing the total Prize Pool and how many players won.

After this the accumulation phase may be restarted at a time configured and set by the operator.

DETAILED DESCRIPTION OF THE PREFERRED EMBODIMENTS

Figure 10:
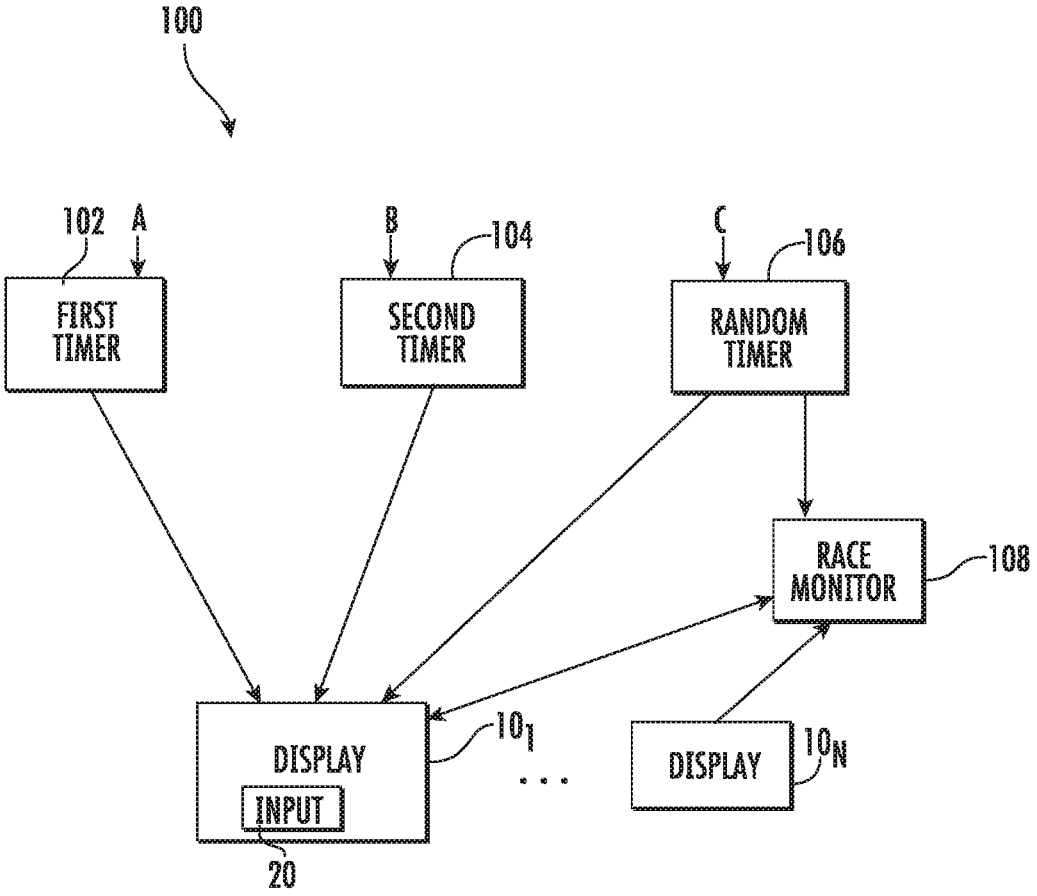
FIG. 10 is a schematic diagram of a system for operating a jackpot race display in accordance with the invention.

Reference is first made to FIG. 10 in which a gaming system, generally indicated as 100, for operating one more displays $\mathbf{10}_1$-$\mathbf{10}_N$ in accordance with timing controls is provided. Display 10 is an interactive display for displaying information about an accumulation phase, a race phase, game status indicators such as characters on open quote ribbons" or the like, and a payout phase. Display 10 includes an input 24 receiving wager or other payment information.

A first timer 102, operatively coupled to display 10, determines a start time and latest end time of a race phase. The start time and end times are determined as a function of an input A and or output directly to display 10 for operating display 10 as discussed below, or in an alternative embodiment to a controller for display 10 not shown. A 2nd timer 104, operatively coupled to display 10, determines the timing of an initiation of an accumulation phase in response to an input B also provides an input for controlling operation of display 10. A random timer 106, operatively coupled to display 10, begins a timing period at or after the first time or start time at the start of the race phase and randomly determines an end to the race phase and the accumulation phase before the latest and time set by the first timer.

A race monitor 108, operatively coupled to display 10, receives the input from input 20 of each display N and monitors the input activity at each display 10. Race monitor 108 also receives at least the input of random timer 106 and determines positions among the players at each of displays $\mathbf{10}_N$ and the payout to be displayed on each display $\mathbf{10}_N$. It should be noted that inputs A, B, C, as well as configuration of race monitor 108 may be determined, in a preferred but nonlimiting example, as an input from the operator.

Reference is now made to FIG. 1 which shows a nonlimiting example of a display 10 of system 100 used in a game. In this example a display 10 shows five vertically extending reels or ribbons 12*a*, 12*b*, 12*c*, 12*d*, and 12*e* (collectively "ribbons 12") showing different characters, symbols or characters or (generally referred to hereafter as characters). The characters are presented in five columns and as the characters move up or down in a vertical direction, they may pass a viewing window 15 or a viewing range. In order to win, a predetermined and specified combination of characters from the reel or ribbons 12 must be aligned in a horizontal line in a viewing window, which in the example shown displays 3 symbols across the ribbons 12. In some versions of this type of game, to win, the characters on each respective ribbon of ribbons 12 must be aligned in a single row extending horizontally across the viewing window. Whilst normally all the characters must be the same, in some games different combinations of characters will qualify as a winning combination and so be allotted a prize. In the present examples, some of the characters are larger than a single character and occupy two sectors of a ribbon. In such cases, the characters must be completely aligned to win a prize.

Display 10 is also provided with a betting/wagering input 20 enabling a player to wager cheering and accumulation period. The input 20 is monitored by race monitor 108 which monitors the amount and time of the input as well as the display 10 with which the wager is associated.

In an upper part of the display 10, a box 16 may exhibit a display box mode in which it provides general information or a counter box mode in which accounts time intervals. In this way box 16 may be used for a number of purposes. In FIG. 1 it is being used to indicate the start of an accumulation phase and the total amount of money in the jackpot.

Figure 2:
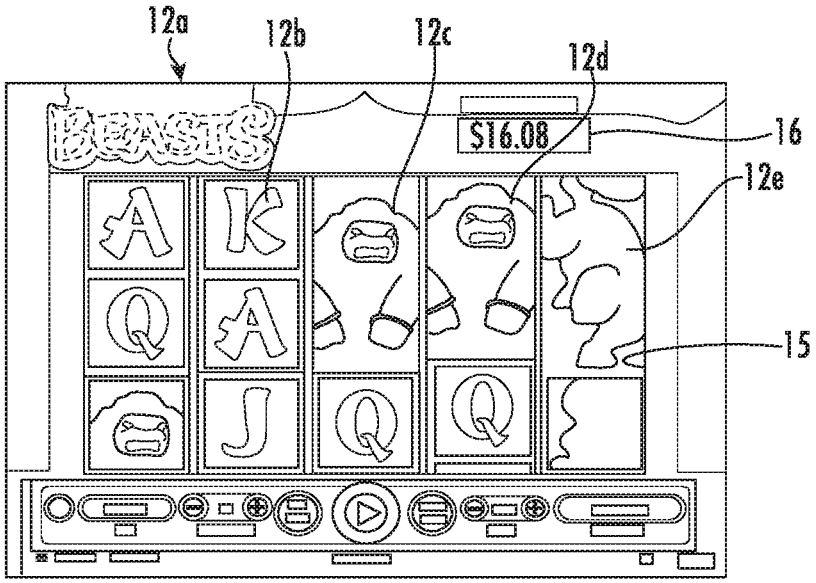
FIG. 2 shows an example of a display during an accumulation phase.

As seen in FIG. 2 an example of a display during an accumulation phase and the display box 16 is giving an indication of the total value of the jackpot.

Figure 3:
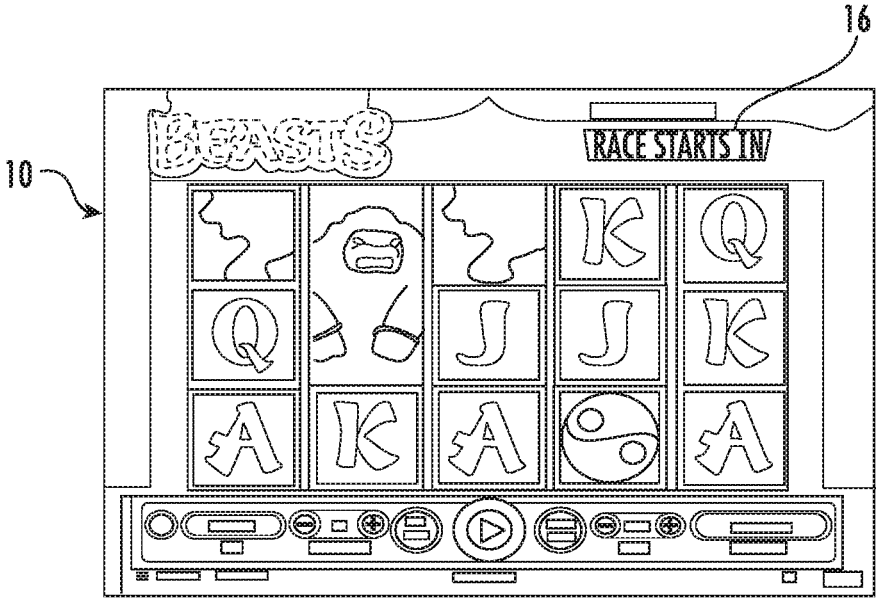
FIG. 3 shows an example of a display during a countdown time to the start of the next race.
Figure 4:
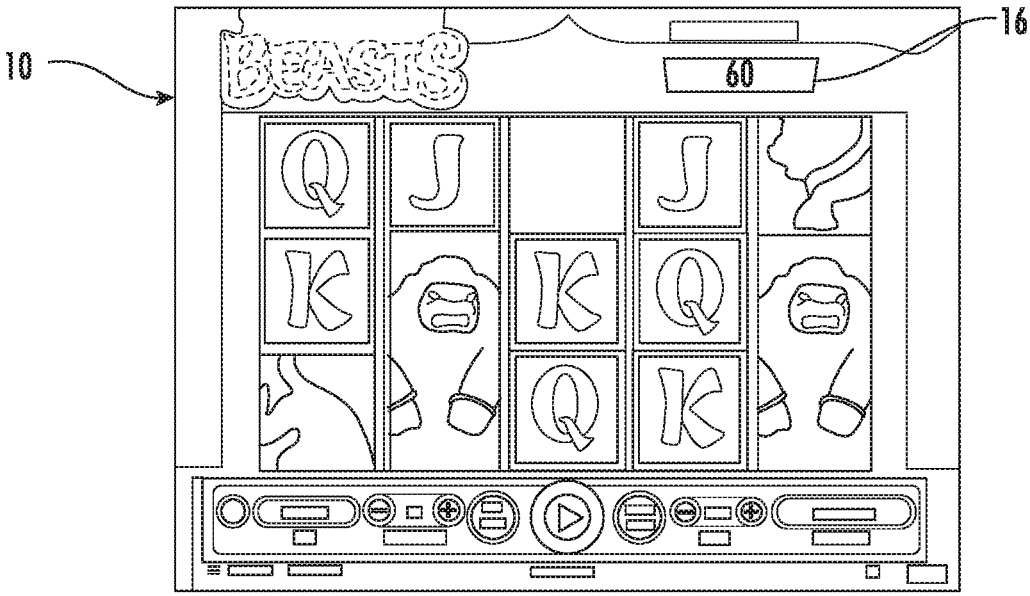
FIG. 4 shows another example of a display during a countdown time to the start of the next race.

As seen in FIGS. 3 and 4 an example of counter box 16 during a countdown to the start of the next race. Clearly, different formats for box 16 can be envisaged, but in this example it is convenient for the display of counter box 16 to be a horizontally scrolling display as shown in FIG. 3 until about 60 seconds before the start, when it becomes a straightforward reverse counter, as shown in FIG. 4, starting from 60 seconds.

Figure 5:
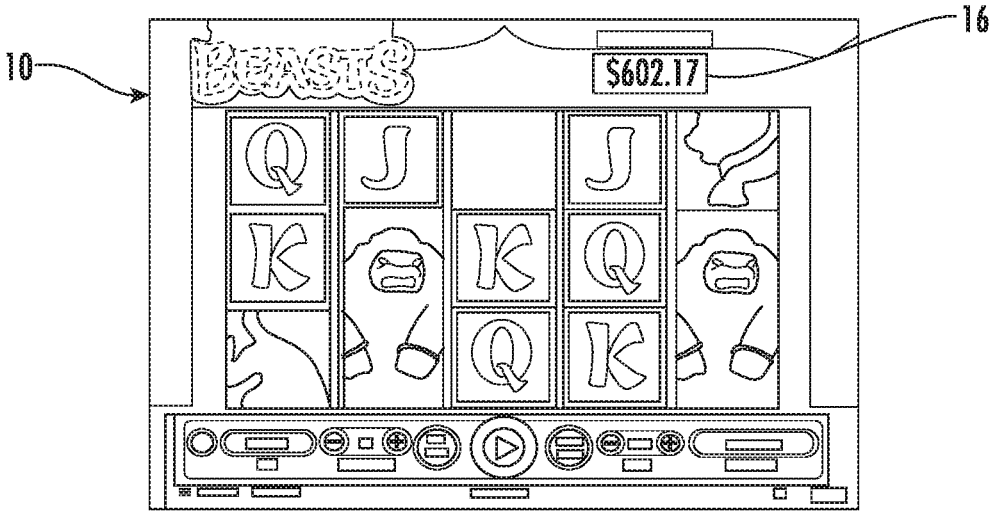
FIG. 5 shows an example of a display with a counter showing the total accumulated in the jackpot at that time.

FIG. 5 shows an example of the counter box 16 with a counter showing the total accumulated in the jackpot prize pot at a time during the race. Clearly, as the time progresses and more wagers are placed, the sum available in the jackpot prize pot increases, so this will be an increasing total.

Figure 6:
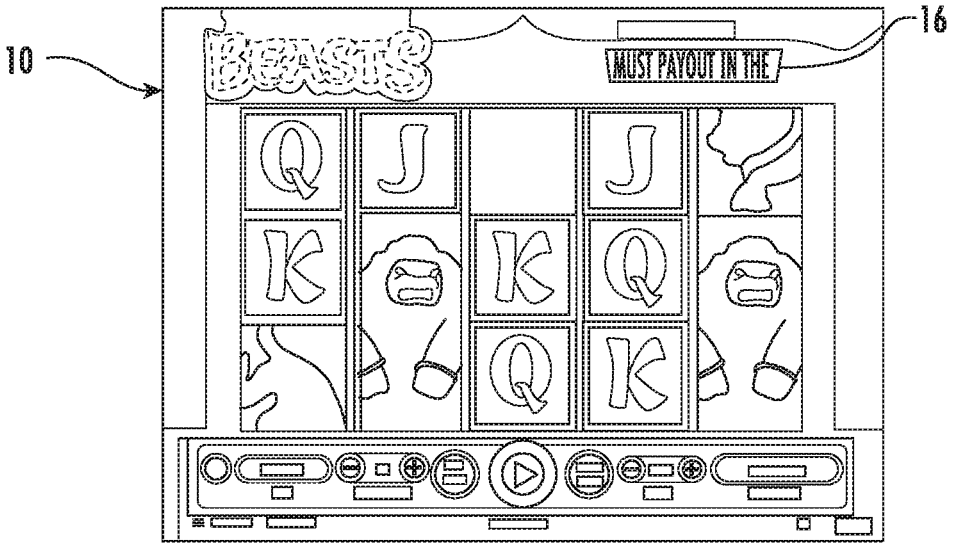
FIG. 6 shows an example of a display during a race and indicating the time by which the jackpot must pay out.
Figure 7:
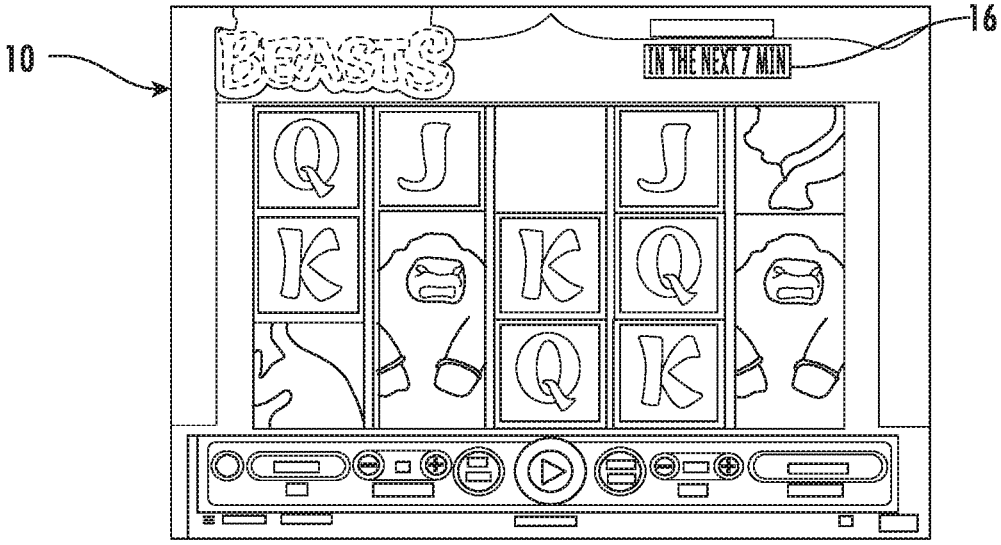
FIG. 7 shows another example of a display during a race and indicating the time by which the jackpot must pay out.

FIGS. 6 and 7 show examples of a display during a race and indicating the time by which the jackpot must pay out;

this can be in the form of a scrolling message. In this example the message scrolls through the counter box 16.

Random timer 106 is used to generate a signal to end the race. At the end of the race, it is necessary to determine the ranking positions of the various players in order that the prizes can be allocated. The criteria for determining a winner are set by the operator. Normally the winner will be considered to be the player who has placed a bet closest to the time the race ends. In the instance where there are potentially up to ten winners, as shown in the table above, the prizes will be awarded in order so that the player who places a bet or starts a roll of the reels or ribbons closest to the time the trigger ends the race will be awarded first prize, the player who is second closest, will be awarded second prize and the third closest will be awarded third prize and so on. Once the race has ended and the ranking of the players completed, the prize or prizes from the jackpot are paid out. Table 1 above provides a non-limiting example of a table for the distribution of the jackpot prize.

Clearly, the number of winners and the fraction of the jackpot paid-out to each of them can be varied, either race to race or over a longer period of time. The jackpot prizes are then paid to the winners. Normally, all the jackpot prize pot will be awarded to the winners according to the percentages shown in the table, but if not, any remaining sums can be rolled over or allocated to the Jackpot prize pot for the next race or retained by the operator. If for example, ten places are configured to be winners and so would be paid out but during the race only five players are playing then the five playing will be paid and the money in the jackpot for the remaining five places will either roll over to the next race or the race simply ends and no funds are rolled over, these excess funds will be retained by the operator.

The operator may also choose to configure the race so that in order to be considered an active player and so be a potential winner, the player must have placed his last bet or wager, or rolled the reels within a predetermined time of the jackpot being triggered and the race ending. For example, if each game lasts approximately two minutes, then the player could be required to have placed his last bet or wager within the previous five minutes. Clearly the durations of games vary and so the time since the last bet or wager can also be varied to suit the nature of the game. The intention is to avoid a player being awarded a place and so being a winner if there are only, say, five players and the player has not been active for a period above a pre-determined threshold period.

Figure 8:
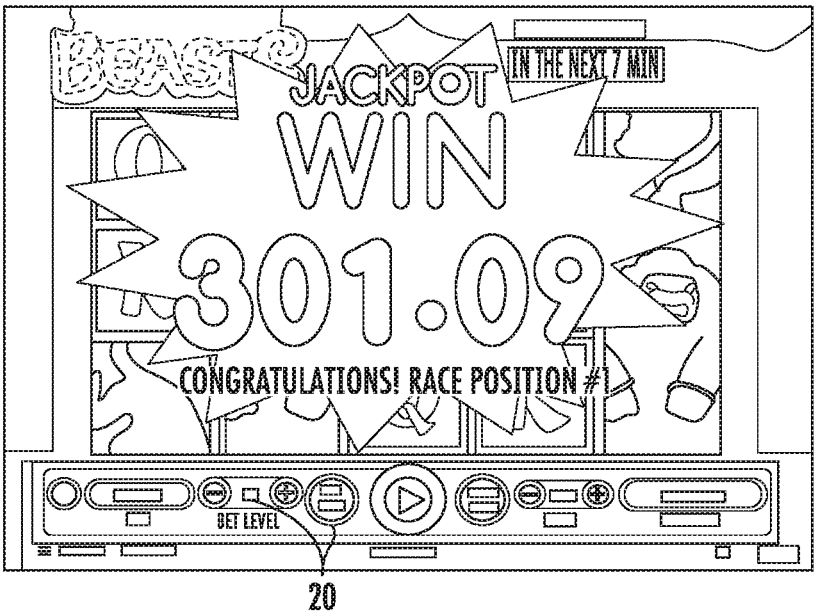
FIG. 8 shows an example of a display for a jackpot winner.

FIG. 8 shows the type of screen for display 10 that could be displayed to a winner. Clearly, other formats for display 10 can be envisaged. Additionally, information could be made available to all players about the number of winners and the values of the first few prizes allocated in a particular race.

Figure 9:
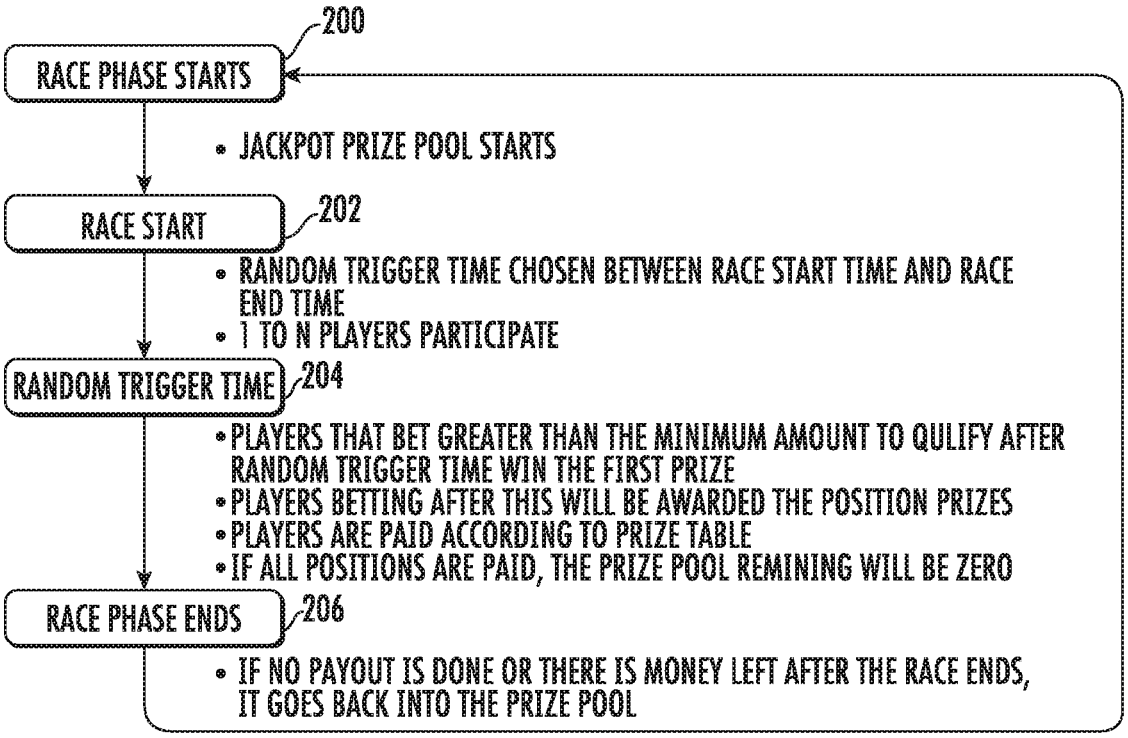
FIG. 9 is a flow chart showing the sequence of events from the start of a race to the end.

Reference is now made to FIG. 9 in which a sequence of operation of the main events from the start to the end of the race phase is provided. At the race phase start, in a step 200, the race timer is set at t=0. The jackpot accumulation or second timer can be set, in a step 202, to start at the same time as the race or a later time, according to the intentions of the operator. Additionally, in a step 204, a random trigger timer is started at the same time, although this need not necessarily be the case. Preferably, the race timer and accumulation timer start at the same time. The race timer will have start times and end times, or maximum race duration times set by the operator. Optionally, this information can be displayed to the players at their respective displays N. During the race, the players will be free to place bets or wagers. A proportion of the bets, wagers or fees paid by the players will be allocated to the Jackpot prize. At some time during the race, $t_j$ the jackpot trigger will randomly trigger (Random Trigger Time) and so bring the race to an end in a step 206. At the end of the race the accumulation phase also ends. Gaming system 100 will then determine the winners and arrange for them to be paid out. The operator can configure the system to determine how the winners are calculated. Preferably, the winner will be the player who places a bet closest to the time $t_j$, the time when the jackpot trigger signals an end to the race. The operator can configure the system to determine how many players will be awarded prizes and the share of the jackpot they will receive. A non-limiting example of the type of pay-out scheme is given above. After the end of the race and the pay-out phase, the timers can all be reset. The races can be configured to be of different durations, and the operator can decide how frequently to run the races.

The jackpot trigger can be realised in a number of ways. One example could be the use of a random timer that is configured to trigger before the end of the race. Other forms of random number generators can be used to trigger the end of the race.

The present system is suitable for use in a casino or other venue where such machines can be legally placed and used. It is also suitable for an on-line gaming system in which the players are remote from a server and possibly other players.

Thus, there have been shown, described and pointed out novel features of the present invention as applied to preferred embodiments thereof, it will be understood that various submissions and substitutions and changes in the form and detail are contemplated to the disclosed invention which may be made by those skilled in the art without departing from the spirit and scope of the invention. It is the intention therefore to be limited only as indicated by the scope of the claims appended hereto. It is also to be understood that the following claims are intended to cover all of the generic and specific features of the invention herein described and all statements of the scope of the invention which, is a matter of language, might be said to fall there between.

What is claimed is:

1. A jackpot race component for a gaming system played by a plurality of players, the jackpot race component comprising:

i. a first timer configured to time a race phase, the race phase having an interval, the interval having a start time and an end time, the first timer further configured to determine the start time and the end time in response to a first input, the first timer setting the start time and a latest end time of the race phase;

ii. a second timer configured to receive a second input and initiating an accumulation phase during which a jackpot prize pot is accumulated, the accumulation phase starting at the same time as or after the start time of the race phase;

iii. a random timer configured to time an end to the accumulation phase and the race phase, the random timer configured to start at or after the first timer at the start of the race phase and the random timer randomly triggering an end to the race phase and the end to the accumulation phase before the latest end time set by the first timer;

iv. the gaming system configured to receive the end to the race phase from the random timer and assign positions to the plurality of players at the end of the race phase; and v. a pay-out phase occurring after the end of the race phase, the pay-out phase being configurable, as a function of a third input, and the gaming system paying out one or more prizes from the jackpot prize pot according to a predetermined pay-out schedule as a function of the positions.

2. The jackpot race component of claim 1, wherein a proportion of any wager, betting stake placed or fee paid by a player during the accumulation phase may be added to the jackpot prize pot as a function of a fourth input.

3. The jackpot race component of claim 1, further comprising a display, the display displaying to the players one or more of the time remaining until the start of the race phase, the actual start time of the race phase, the duration of the race phase, the latest time at which the race phase can end.

4. The jackpot race component of claim 1, wherein after the end of the race has been triggered, players are ranked in order according to how close to the random trigger time each respective player placed a bet, wager or paid a fee.

5. The jackpot race component of claim 1, in which at least one of: 1) the number of prizes to be paid from the jackpot, 2) the fractions of the jackpot prize pot to be awarded as prizes to the players and 3) the relative sizes of the jackpot prizes is determined as a function of an operator input.

6. The jackpot race component of claim 1, in which the jackpot component forms a part of the gaming system as a spinning reel or slot machine type of game.

7. The jackpot race component of claim 1, wherein at least one of the first input, second input and third input is an operator input.

8. The jackpot race component of claim 1, wherein the first timer is configured to start at a same time as the second timer and the first timer is configured to end at the same time as the second timer.

9. The jackpot race component of claim 1, wherein the first timer and the second timer perform the same function.

10. A method of operating a jackpot race component for a gaming system played by a plurality of players, the method of operating including:

i. providing a first input to a first timer, the first timer being configured to set a phase time interval by determining a start time and an end time, in response to the first input, as a start time and latest end time of the race phase;

ii. providing a second input to a second timer, the second timer being configured to initiate an accumulation phase in response to a second input, during which a jackpot prize pot is accumulated, the accumulation phase being configured to start at the same time as one of a beginning of the race phase or after the beginning of the race phase; providing a random timer, the random timer being configured to start timing at or after the start of the race phase, as determined by the first timer, and configuring the random timer to randomly trigger an end to the race phase and an end to the accumulation phase before the latest end time set by the first timer;

iii. the gaming system assigning positions of the players in response to the end of the race phase; and iv. the gaming system determining a pay-out phase, the determination of the pay-out phase occurring in response to the end of the race phase and the gaming system paying out one or more prizes from the jackpot prize pot according to a predetermined pay-out schedule as a function of the positions.

11. The method of operating a jackpot race component of claim 10, further comprising the step of configuring any proportion of any wager, or betting stake placed or fee paid during the accumulation phase to be added to the jackpot prize pot.

12. The method of operating a jackpot race component of claim 10, further comprising the step of displaying to the players at at least one display at least one of a) the time remaining until the start or b) the actual start time of the race phase, or c) the maximum race time remaining or d) the latest actual end time of the race phase.

13. The method of operating a jackpot race component of claim 10, further comprising the step of configuring at least one of 1) the number of prizes to be paid out in the pay-out phase, 2) the fractions of the jackpot prize pot to be awarded as prizes to the players and 3) the relative sizes of the jackpot prizes.

14. The method of operating a jackpot race component of claim 10, wherein the gaming system includes a spinning wheel or slot machine type of game; and the jackpot race component operates through the spinning wheel or slot machine type of game.

15. The method of operating a jackpot race component of claim 10, wherein the first timer is configured to start at a same time as the second timer and the first timer is configured to end at the same time as the second timer.

* * * * *